US006133718A

United States Patent [19]

Calafato et al.

[11] Patent Number: 6,133,718

[45] Date of Patent: Oct. 17, 2000

[54] TEMPERATURE-STABLE CURRENT GENERATION

[75] Inventors: Carmela Calafato, Milazzo; Maurizio Gaibotti, Cesano Maderno, both of Italy

[73] Assignee: STMicroelectronics S.r.l., Milan, Italy

[21] Appl. No.: 09/246,029

[22] Filed: Feb. 5, 1999

[30] Foreign Application Priority Data

Feb. 5, 1998 [IT] Italy ..... MI98A0219

[51] Int. Cl.[7] ..... G05F 3/04; G05F 3/16

[52] U.S. Cl. ..... 323/312; 323/315; 323/907; 323/314

[58] Field of Search ..... 323/312, 313, 323/314, 315, 316, 907; 327/538

[56] References Cited

U.S. PATENT DOCUMENTS 4,016,435 4/1977 Voorman ..... 327/538

*Primary Examiner*—Jessica Han
*Attorney, Agent, or Firm*—Jenkens & Gilchrist, P.C.; Theodore E. Galanthay

[57] ABSTRACT

A first current generator which generates a current that is based on the threshold difference of enhancement-type and native-type transistors therein. A second current generator which generates a current that is based on the thermal voltage. The currents generated by the first and second current generators are linearly combined to produce a highly temperature-stable current.

16 Claims, 5 Drawing Sheets

TEMPERATURE-STABLE CURRENT GENERATION

BACKGROUND OF THE INVENTION

1. Technical Field of the Invention

The present invention relates to a highly temperature-stable current generator. More particularly, the invention relates to a current generator which operates even at low supply voltages (<2.0 v) and with currents in the $\mu$A range. The operation of the current generator depends on the characteristics of the technology and can be operable at supply voltages of 1.0 v.

2. Background of the Invention

Conventional design of circuits operating at ever lower voltages (below 2.0 v) required by battery-powered applications poses the problem of producing, in CMOS technology, a highly temperature-stable and/or temperature-insensitive current generator which is capable of producing a reference current in the $\mu$A range (in order to have low consumption) with a supply voltage of approximately up to 1.8–2.0 v.

In particular, such current generators are employed in the circuits of nonvolatile memories, such as memory cells of the EEPROM type, to read the content of memory cells (current-driven reading), and in other analog support blocks.

In integrated circuits, analog circuits are usually biased by using conventional current generators, wherein the reference is independent of the supply voltage.

For example, as shown in FIGS. 1 to 4, the following current generators are known: generators which utilize the difference in threshold voltage, $\Delta$Vth, between enhancement-type and native-type (low threshold) transistors (FIG. 1), in which the current reference is given by I=$\Delta$Vth/R; generators which utilize the thermal voltage $V_T$=KT/q (FIG. 2, where the transistors M1 and M2 have different sizes) ; generators which utilize the overdrive difference between two transistors of the same type (transistors M1, M2 in FIG. 2) having different channel width-to-length (W/L) ratios, for which I=$\Delta$Vov/R (FIG. 3); and generators which generate a reference current based on the voltage across the base and the emitter of a bipolar transistor 20 (FIG. 4), so that the current is equal to I=Vbe/R, where Vbe is the base-emitter voltage of the bipolar transistor 20.

In all the above-cited cases, the resulting current references vary with temperature, due to the fact that the resistance of the resistor and the reference voltage corresponding thereto vary according to this parameter.

The variations exhibited by such current references are on the order of 10% or more.

SUMMARY OF THE INVENTION

The aim of the present invention is to provide a current generator which is highly temperature-stable and/or temperature-insensitive.

Within the scope of this aim, an object of the present invention is to provide a current generator which operates even at very low supply voltages and with currents in the $\mu$A range.

Another object of the present invention is to provide a current generator which is highly reliable and relatively easy and inexpensive to produce.

The present invention overcomes the shortcomings associated with known current generators and satisfies a significant need for a highly temperature-stable current generator, by including a first current generator which generates a current which is based on a threshold difference between enhancement-type and native-type transistors located therein, and a second current generator which generates a current that is based on the thermal voltage. The currents generated by the first and second current generators are combined using a linear method in order to obtain a temperature-stable reference current.

BRIEF DESCRIPTION OF THE DRAWINGS

Further characteristics and advantages of the present invention will become apparent from the following detailed description of a preferred but not exclusive embodiment of the current generator according to the invention, illustrated by way of a non-limitative example in the accompanying drawings, wherein.

DESCRIPTION OF THE PREFERRED EMBODIMENTS

It has been observed that the reference current supplied by a conventional current generator 10 (FIG. 1) utilizes the difference between the threshold voltage of an enhancement-type transistor and the threshold voltage of a native-type transistor 1. The current generated by current generator 10 decreases as the temperature decreases, as shown in FIG. 5.

Figure 1:
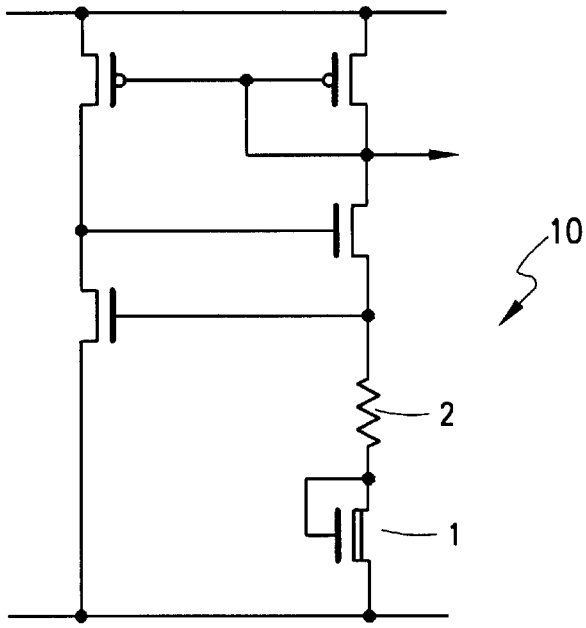
FIG. 1 (PRIOR ART)
FIG. 1 is a circuit diagram of a conventional current generator which generates a current that is based on the difference in threshold voltages between transistors of different types.

In practice, the component $\Delta$Vth, which represents the difference between the threshold voltage of the enhancement transistor and the threshold voltage of the native transistor 1, tends to have a very limited thermal drift in comparison with the thermal drift of the resistor 2, which is very high and accordingly constitutes the predominant temperature dependent component for the current generator of FIG. 1.

This thermal dependency is more conspicuous if diffusion resistors with a high resistivity on the order of 1–2 kohm/square are employed in order to obtain currents which are lower than 1 $\mu$A.

Figure 5:
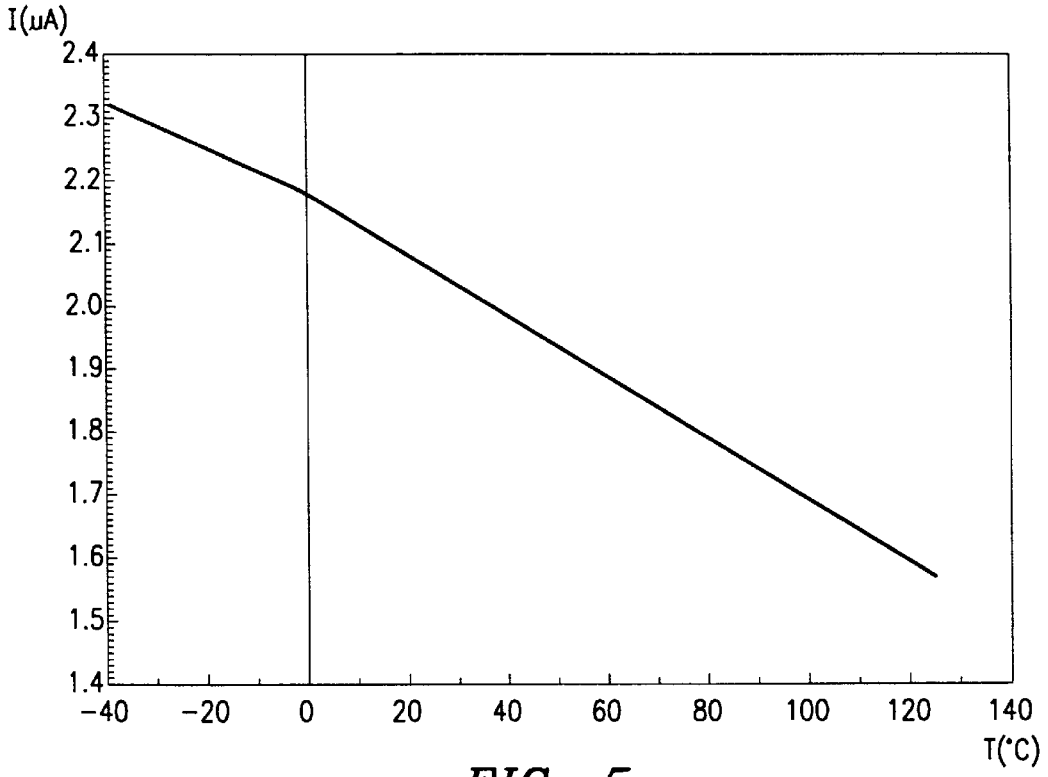
FIG. 5 (PRIOR ART)
FIG. 5 is a graph illustrating the behavior of the circuit shown in FIG. 1.

FIG. 5 illustrates the behavior of conventional current generator 10 of FIG. 1 as the temperature varies with a current of approximately 0.25 $\mu$A.

Figure 2:
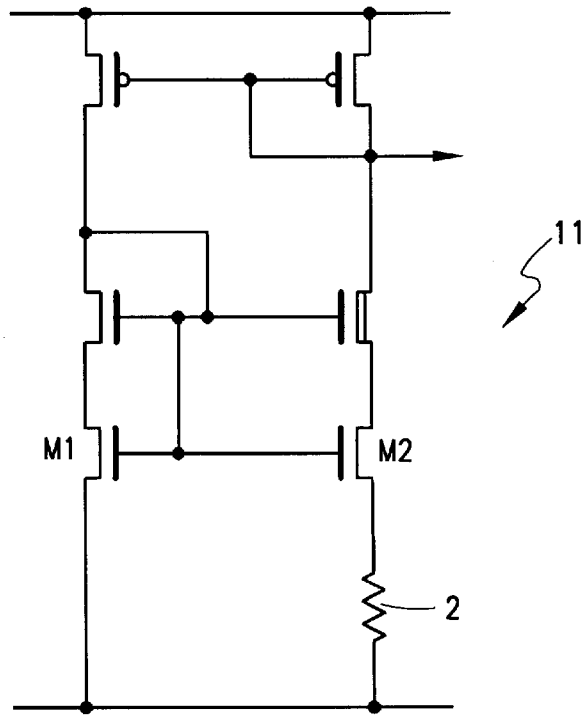
FIG. 2 (PRIOR ART)
FIG. 2 is a circuit diagram of a conventional current generator which generates a current that is based on the thermal voltage.
Figure 3:
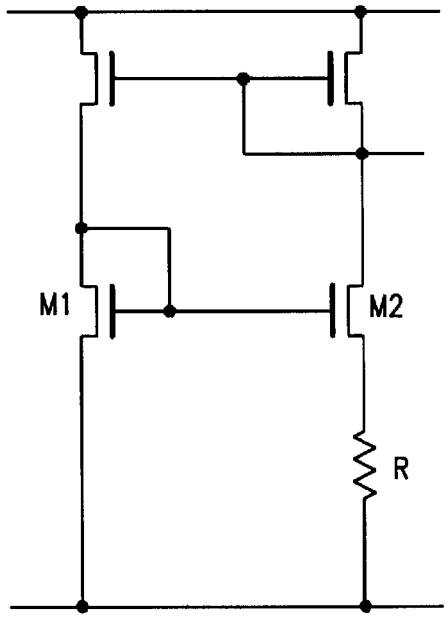
FIG. 3 (PRIOR ART)
FIG. 3 is a circuit diagram of a conventional current generator which generates a current that is based on the difference in overdrive between transistors of the same type but with different W/L ratios.
Figure 4:
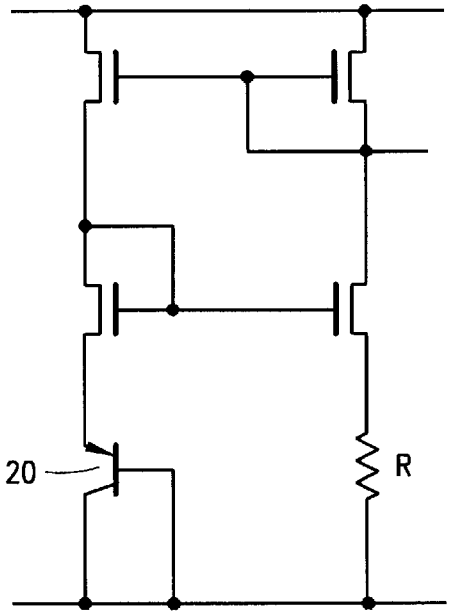
FIG. 4 (PRIOR ART)
FIG. 4 is a circuit diagram of a conventional current generator which generates a current that is based on the voltage across the base and emitter electrodes of a bipolar transistor.
Figure 6:
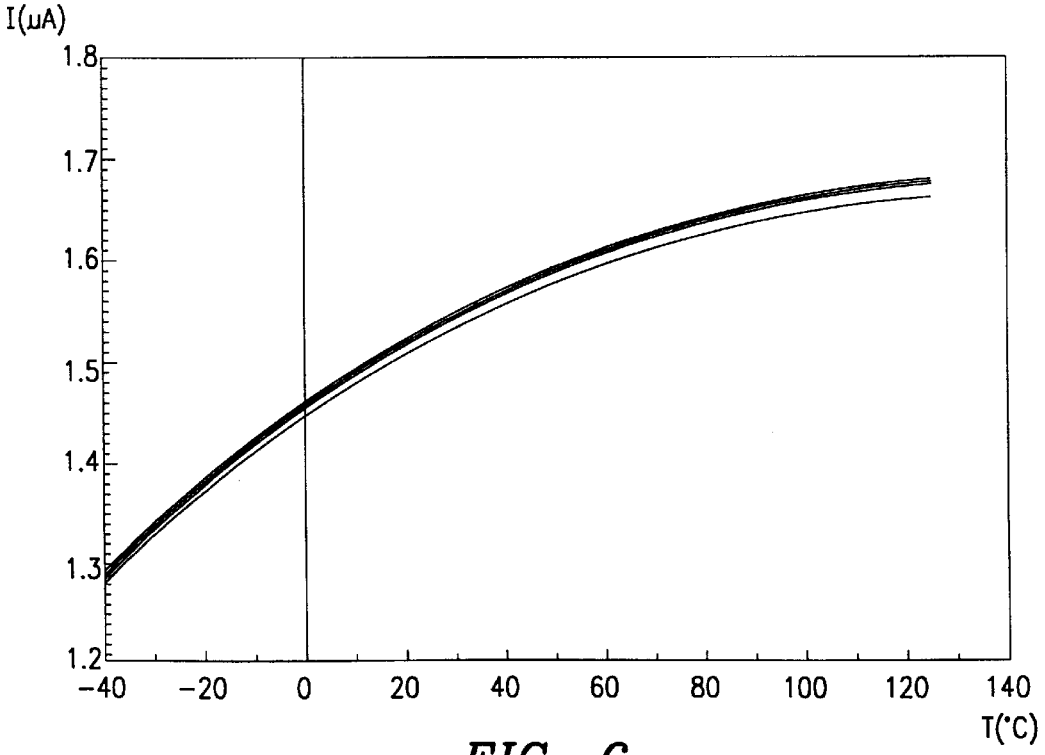
FIG. 6 (PRIOR ART)
FIG. 6 is a graph illustrating the behavior of the current generator circuit shown in FIG. 2.

A second conventional current generator 11, shown in FIG. 2, generates a current that is based on the thermal voltage $V_T$, thereby supplying a current with a positive thermal drift due to the thermal effect of the diffusion resistor 2. FIG. 6 illustrates the behavior of conventional current generator 11 as a function of temperature.

Figure 7:
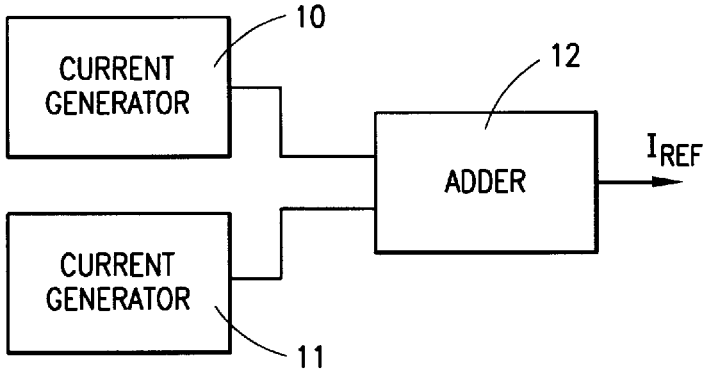
FIG. 7 is a block diagram of the current generator circuit according to the present invention.
Figure 8:
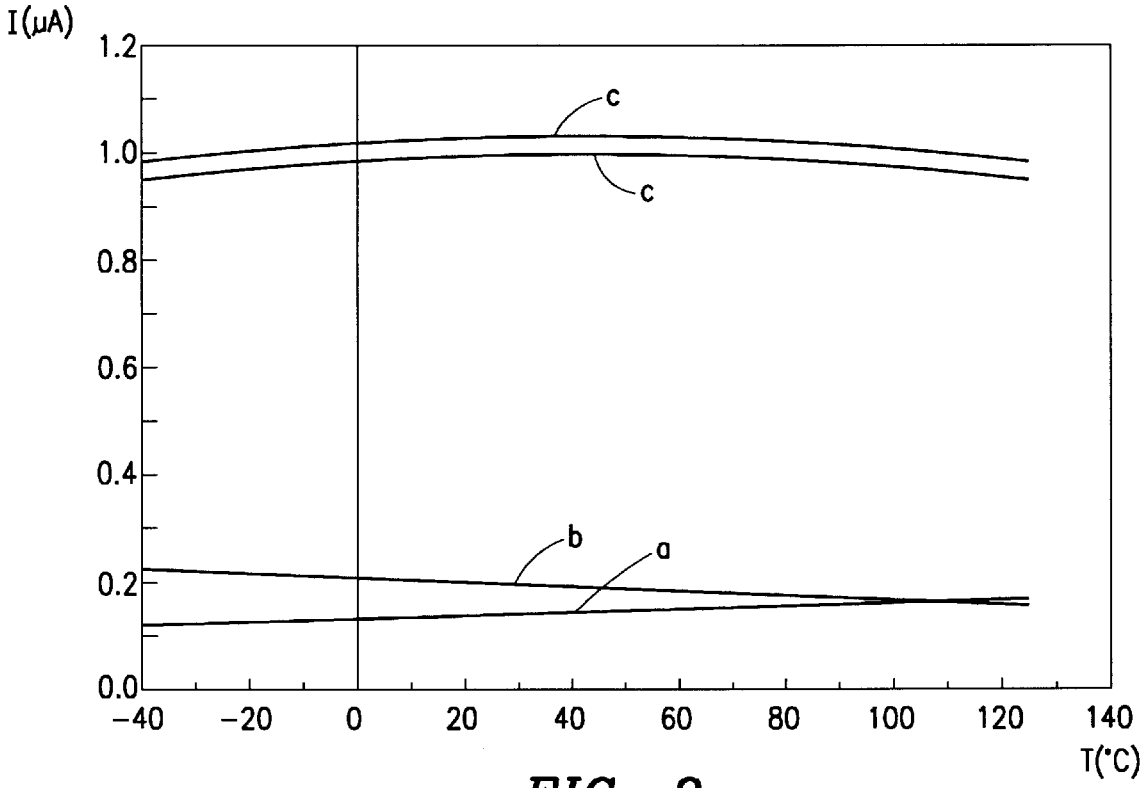
FIG. 8 is a graph illustrating a comparison between the behavior of the current generator circuits of FIGS. 1 and 2 with the behavior of the current generator circuit of FIG. 7.
Figure 9:
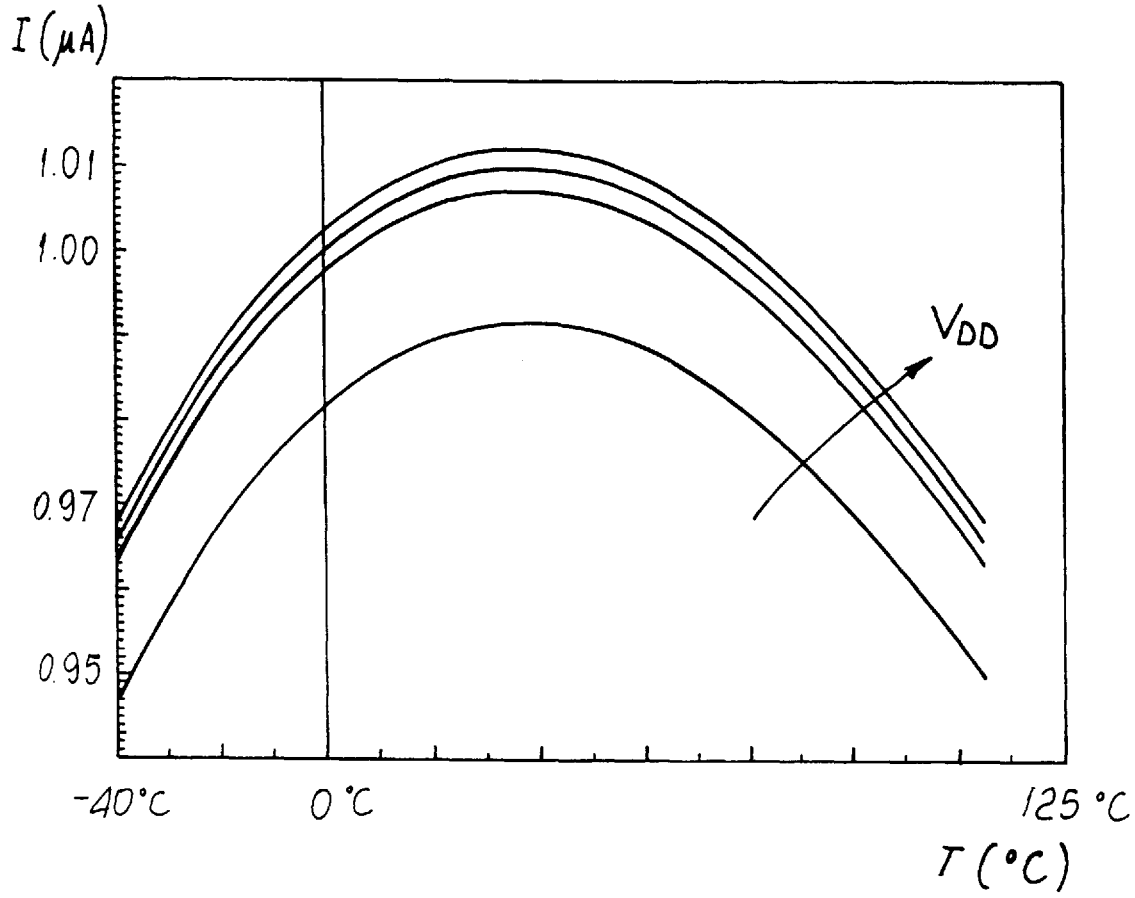
FIG. 9 is a graph illustrating the behavior of the current generator according to the present invention across variations in temperature and power supply voltage.

With reference to FIGS. 7–9, the current generator according to the present invention is provided as follows.

The current generator according to the present invention utilizes a linear combination of the currents supplied by the above-described current generators, i.e., by the current generator 10 of FIG. 1 and by the current generator 11 of FIG. 2, so as to compensate for the two different temperature gradients thereof. In this manner it has been possible to obtain a very stable current reference.

Referring to FIG. 7, there is shown a block diagram of the current generator 13 according to the present invention. The reference numeral 10 designates current generator 10 which generates a current that is based on the difference in the activation thresholds of transistors of the enhancement and native types, as shown in FIG. 1, while the reference numeral 11 designates current generator 11 which generates a current that is based on the thermal voltage, as shown in FIG. 2.

The block designated by the reference numeral 12 provides a sum of the currents emitted by the current generators 10 and 11 in order to output a reference current Iref which is highly temperature-stable.

The current Iref supplied by the reference thus provided is expressed by the following equation:

$$Iref = \frac{\Delta Vth + \alpha kT\frac{\ln M}{q}}{R}$$

where $\alpha$ is a coefficient which provides the linear combination.

The value of $\alpha$ can be calculated or predetermined by requiring zero to be the derivative of the reference current with respect to the temperature.

It can be observed that in the temperature interval between −40 and 125° C. the resulting current reference has variations limited to 4%, as shown in FIGS. 8 and 9.

In the above-identified current formula there are provided two current components which are given by the reference current generated by current generator 10 based on the difference in threshold voltages between enhancement-type and native-type transistors therein, and by the current generated by current generator 11 which generates a current based upon the thermal voltage $V_T$=KT/q. FIG. 8 plots a comparison between the behavior of the current components generated by current generators 10 and 11 having different (positive and negative) thermal drift, designated by a and b respectively, and the behavior of the current reference obtained by means of the linear combination of these two components, i.e., the resulting reference current Iref designated by c in FIG. 8.

In practice it has been found that the current generator according to the invention fully achieves the intended aim, since it provides a current reference Iref which is highly temperature-stable and operates even at low supply voltages, with currents on the order of 1 $\mu$A.

Although the preferred embodiments of the system and method of the present invention have been illustrated in the accompanying drawings and described in the foregoing detailed description, it will be understood that the invention is not limited to the embodiments disclosed, but is capable of numerous rearrangements, modifications and substitutions without departing from the spirit of the invention as set forth and defined by the following claims.

What is claimed is:

1. A temperature-stable current generator, comprising:

a first current generator which generates a current that is based on a threshold difference between enhancement-type and native-type transistors therein;

a second current generator which generates a current that is based on thermal voltage; and a circuit for linearly combining the currents generated by said first and said second current generators based upon a predetermined parameter to generate a substantially temperature-stable reference current, the predetermined parameter being a coefficient that is obtained by equating a derivative of current generated by the first current generator with respect to temperature to a derivative of current generated by the second current generator with respect to temperature, the current from one of the first and second current generators being scaled by the coefficient prior to being combined with the current from the other of the first and second current generators.

2. The current generator of claim 1, wherein:

the circuit for linearly combining the currents generated by said first and said second current generators comprises a current adder circuit.

3. A current generator, comprising:

a circuit for receiving a first reference current having a positive thermal drift and a second reference current having a negative thermal drift, and for combining the first reference current and the second reference current based upon a predetermined coefficient to produce a substantially temperature-insensitive current, the predetermined coefficient being obtained by equating a derivative of the first reference current with respect to temperature to a derivative of the second reference current with respect to temperature, the circuit scaling one of the first and second reference currents prior to being combined with the other of the first and second reference currents.

4. The current generator according to claim 3, wherein:

the circuit linearly combines the first reference current and the second reference current.

5. The current generator according to claim 3, wherein: the circuit comprises a current adder circuit.

6. The current generator according to claim 3, further including:

a first generator circuit, coupled to the circuit, which generates the first reference current; and a second generator circuit, coupled to the circuit, which generates the second reference current.

7. The current generator according to claim 6, wherein:

the first generator circuit includes a transistor of a first type and a transistor of a second type, such that the first reference current is based upon the difference in threshold voltages between the transistor of the first type and the transistor of the second type.

8. The current generator according to claim 7, wherein:

the transistor of the first type is an enhancement-type transistor; and the transistor of the second type is a native-type transistor.

9. The current generator according to claim 3, wherein:

the second current is dependent upon the thermal voltage.

10. A method of generating a substantially temperature-insensitive current, comprising the steps of:

generating a first reference current having a positive thermal drift;

generating a second reference current having a negative thermal drift; and combining the first reference current with the second reference current to generate the substantially temperature-insensitive current, comprising the steps of:

determining a chance in the first reference current with respect to temperature;

determining a change in the second reference current with respect to temperature;

equating the chance in the first reference current to the change in the second reference current to obtain a coefficient; and utilizing the coefficient to scale one of the first and second reference currents prior to combining.

11. The method of claim 10, wherein:

the step of combining comprises the step of linearly combining the first reference current with the second reference current.

12. The method of claim 11, wherein:

the step of utilizing further comprises the steps of multiplying one of the first and second reference currents by the coefficient to obtain a third reference current, and adding the other of the first and second reference currents to the third reference current.

13. The method of claim 10, wherein:

the first reference current is based upon a difference in threshold voltages between transistors of different types.

14. The method of claim 10, wherein:

the second reference current is based upon the thermal voltage.

15. The method of claim 10, wherein the step of determining a change in the first reference current comprises the step of determining a derivative of the first reference current with respect to temperature.

16. The method of claim 10, wherein the step of determining a change in the second reference current comprises the step of determining a derivative of the first reference current with respect to temperature.

* * * * *

UNITED STATES PATENT AND TRADEMARK OFFICE

CERTIFICATE OF CORRECTION

PATENT NO : 6,133,718

DATED : October 17, 2000

INVENTOR(S): Carmela Calafato and Maurizio Gaibotti

It is certified that error appears in the above-identified patent and that said Letters Patent are hereby corrected as shown below:

| | |
|---|---|
| Column 5, line 13 | Replace "chance" With --change-- |
| Column 5, line 17 | Replace "chance" With --change-- |

Signed and Sealed this

Eighth Day of May, 2001

*Attest:*

Nicholas P. Godici

NICHOLAS P. GODICI

*Attesting Officer*

*Acting Director of the United States Patent and Trademark Office*